United States Patent [19]

Miller

[11] 4,113,607

[45] Sep. 12, 1978

[54] DENITRIFICATION PROCESS FOR HYDROGENATED DISTILLATE OILS

[75] Inventor: Stephen J. Miller, Emeryville, Calif.

[73] Assignee: Chevron Research Company, San Francisco, Calif.

[21] Appl. No.: 773,995

[22] Filed: Mar. 3, 1977

[51] Int. Cl.[2] ..... C10G 21/00; C10G 29/12

[52] U.S. Cl. ..... 208/254 R

[58] Field of Search ..... 208/254 R, 251 R

[56] References Cited

U.S. PATENT DOCUMENTS

| | | | |
|---|---|---|---|
| 2,507,861 | 5/1950 | Manley | 208/254 R |
| 2,846,358 | 8/1958 | Bieber et al. | 208/251 R |
| 2,847,362 | 8/1958 | Kemp | 208/254 R |
| 3,193,496 | 7/1965 | Hartung | 208/254 R |

*Primary Examiner*—George Crasanakis

*Attorney, Agent, or Firm*—D. A. Newell; R. H. Davies; D. L. Hagmann

[57] ABSTRACT

A process is disclosed for upgrading a hydrogenated distillate oil by extracting nitrogen compounds from the oil. In the process, these compounds are selectively extracted from the oil in a liquid-liquid extraction using as the extracting medium a solution of ferric chloride in furfural. Following intimate contacting of the oil with the extracting solution, the resulting mixture is separated into an oily raffinate phase and a solvent-extract phase. The raffinate oil is especially suitable as a feedstock for a catalytic cracking or hydroprocessing stage employing an acidic catalyst. The extraction is carried out under moderate conditions of temperature and pressure.

9 Claims, No Drawings

DENITRIFICATION PROCESS FOR HYDROGENATED DISTILLATE OILS

BACKGROUND OF THE INVENTION

This invention relates to upgrading a hydrogenated oil. More particularly, a combination process is provided wherein in large part the nitrogenous component of a hydrogenated oil is reduced in size by a novel extraction of the oil, and the extracted oil is thereafter converted to a more desirable product in a separate hydrocarbon processing stage.

It is known that nitrogen compounds, when present in an oil, deleteriously affect acidic catalysts used in subsequent hydroprocessing of the oil. Usually, the nitrogenous material or residual material therefrom causes undesirable deactivation of the catalyst. Consequently a variety of treatments are taught in the art for reducing the organic nitrogenous component content of an oil. In the art of upgrading distillate oils, hydrofining or hydrotreating using a suitable catalyst is a common and frequently used expedient. The treatment produces a more-or-less satisfactory result, provided: (1) a subsequent hydroprocessing stage employs a catalyst which is relatively insensitive to nitrogen compounds, or (2) the hydrotreating conditions employed are severe enough to reduce the nitrogen content of the treated oil to a satisfactory level, for example below 10 ppmw, preferably below about 2 ppmw. There are drawbacks. The more effective (active) and desirable processing catalysts, for example those whose catalytic activity depends mainly upon Broensted acid site activity, are, in general, seriously affected by nitrogenous feed contaminants. And hydrotreating conditions severe enough to more satisfactorily reduce nitrogen levels of a treated oil usually cause conversion of an undue portion of the oil to undesirable products, such as coke, light gases, and the like. The use of such severe conditions also causes a relatively higher catalyst deactivation rate for the hydrotreating catalyst. The use of relatively moderate hydrogenating (hydrotreating) conditions, on the other hand, avoids the undesirable conversion of feedstock oil components, yet the resulting oil has an undesirable residual nitrogenous component which is relatively resistant to hydrogenation.

It is an object herein to provide an effective process for extracting residual nitrogenous components from a hydrogenated distillate oil.

A further object is to provide a combination process for upgrading a hydrogenated distillate oil by extracting a residual nitrogenous component from the oil and thereafter usefully hydroprocess the resulting oil by contacting it with an acidic hydroprocessing catalyst under suitable conditions.

A yet further object herein is to carry out the aforementioned upgrading of the distillate oil and to thereafter crack the resulting oil by contacting it with an acidic catalyst or hydrocracking catalyst under suitable conditions.

Other objects and advantages of the present invention will become apparent to those skilled in the art in the following description and illustration of the invention.

SUMMARY OF THE INVENTION

In accordance with the present invention, a process is provided for upgrading a hydrogenated oil containing a residual nitrogenous component, especially wherein the component, calculated as nitrogen, is present in an amount in the range of from about 10 to 600 ppmw, comprising:

(1) extracting, without forming a precipitate, at least a portion of said component from said oil by contacting said oil under liquid-liquid extracting conditions with an organic solution containing ferric chloride solute and, based upon volume, at least a major portion of furfural solvent and the remainder, if any, comprising a lower alkanol, thereby forming (a) a raffinate oil phase having a nitrogenous component which is smaller than that of said distillate oil, and (b) an extract phase containing said extracted portion of said nitrogenous component; and (2) separating said phases.

In a more particular and a preferred aspect of the present invention, a feedstock comprising at least a portion of the oil in the aforementioned separated raffinate oil phase is catalytically cracked or hydroprocessed by contacting the feedstock with an acidic catalytic cracking or acidic hydroprocessing catalyst, said acidity, in the main, being of the Broensted type, thereby producing a more useful product, for example a product having relative to the feedstock (1) a lower average molecular weight, (2) an increased aromatic hydrocarbon content, as from reformation, (3) a composition more closely approximating the equilibrium concentration, as from isomerization, (4) a reduced content of unsaturated hydrocarbons, as from hydrogenation, and (5) in combination, one or more of the characteristics as in items (1)-(4) above.

By "hydrogenated distillate oils" as used herein is meant, by definition, normally liquid hydrocarbon mixtures produced by known methods:

(1) by destructive distillation, in the presence of added hydrogen gas, of one or more hydrocarbonaceous materials, such as coal, tar sand oil, shale oil mixtures thereof, and the like, (usually known as "syncrude oils"), or (2) by treating with hydrogen gas, oils obtained:

(a) as in (1) above, (b) by distilling petroleum crude oils or fractions thereof, or (c) mixtures of oils obtained as in (a) and (b).

The hydrogenated distillate oils desirably used as feedstocks for the process herein contain a nitrogenous component. The component, calculated as nitrogen, is usually present in the oil in parts by weight in an amount in the range of from about 10 to 600 parts per million (ppmw) of the feedstock. The nitrogen-containing compounds making up this nitrogenous component of the oil are residual compounds and comprise nitrogen components which are the more stable of those normally indigenous to petroleum and syncrude oils because they have remained present in the oil even after contact thereof with hydrogen gas under hydrodenitrogenating conditions. Consequently, removal of these residual nitrogen-containing compounds from the oil presents a serious problem to a refiner of oil. Desirably, the nitrogen content of an oil processed as herein should be reduced to a level below 10 ppmw, more preferably below about 2 ppmw. On the other hand, the deactivation of a Broënsted-type acidic catalyst by nitrogen compounds increases, in general, with increasing nitrogen content of a feedstock contacted therewith. Therefore, any significant reduction in nitrogen content of the feedstock by the nitrogen removal method herein, for example by at least a 50% reduction, produces an oil more suitable for use as a feedstock to a catalytic cracking or hydrocracking process employing a catalyst containing acid sites, the major portion of which are Broënsted acid sites.

By "liquid-liquid extracting conditions" as used herein is meant by definition ordinary known conditions therefor, including the use of (1) at least sufficient of the extracting liquid to provide separate extract and raffinate phases, and (2) a combination of temperature and pressure at least sufficient to maintain said liquid phases.

Any suitable form of apparatus may be used. In general, the various means customarily employed in extraction processes to increase the contact area between the oil stock and the solvent can be employed. Thus, the apparatus used in the present process can comprise a single extraction zone or multiple extraction zones equipped with (a) shed rows or stationary devices to facilitate contacting; (b) orifice mixers; or (c) effective stirring decives such as mechanical agitators, jets of restricted internal diameter, turbo mixers and the like. The operation may be conducted in the batch or continuous-type manner, with the latter being preferred. A continuous counter-current operation is a preferred mode, for example, a mode similar to that described in U.S. Pat. No. 3,205,167 (J. Demeester). Known techniques for decreasing the solvent selectivity of the extracting solvent for hydrocarbons can be employed. Examples of these are the use of small amounts of anti-solvents, e.g., water, during the extraction of the oil with the organic solvent, operating at fairly low temperatures sufficient to effect the desired extraction objective, and using low solvent-to-oil ratios.

EMBODIMENT

In a preferred embodiment a hydrogenated creosote oil having a nitrogenous component, calculated as nitrogen, of about 70 ppmw is used as the feedstock. Under ambient conditions of temperature and pressure, this feedstock is extracted in a countercurrent liquid-liquid extracting tower operating at a solvent to oil ratio of about 0.5. Using a furfural solution of ferric chloride containing about 0.2 weight percent of $FeCl_3 . 6H_2O$ as the extracting medium and, if desired, with prior equilibration of the feedstock with the extracting solvent, for example by contacting the feedstock with the extract phase of a downstream extractor, a raffinate oil phase having a nitrogen content of about 2 ppmw is produced. The estimated yield of extracted oil, based upon feedstock, exceeds 98%. After removal of a minor amount of furfural from the raffinate phase, for example by water washing or fractionating, the recovered oil is hydrocracked to produce a 30°API gravity oil (corresponds to 55% conversion to 400° F− product). For the hydrocracking, the catalyst is desirably an acidic catalyst containing about 0.1 mmol of Broensted acid sites per gram and comprising a platinized silica-alumina matrix containing about 10 weight percent of a crystalline zeolitic molecular sieve of a faujasite type in the H form. The hydrocracking conditions desirably used include:

Pressure, psig:2200
LHSV: 1.0
Hydrogen rate, SCF/bbl $\times 10^3$:12

Feedstock

Hydrogenated distillate oils, in general, are upgraded by the process herein and are contemplated for use as feedstocks. Preferred oils have a residual nitrogenous component content, calculated as nitrogen, in the range of from about 10 to 600 ppmw, more preferably 25 to 400 ppmw. Best results, from an over-all processing viewpoint, are believed to be achieved when the residual nitrogen content is in the range of from about 50 to 150 ppmw.

Representative hydrogenated distillate oils contemplated for use herein include syncrude oils, that is oils obtained by hydrogenating carbonaceous materials, such as coal, tar sand oil, shale oil, and the like; hydrofined petroleum distillates and fractions thereof, hydrogenated coke oven distillates, such as creosote-type oils, and the like oils resulting from pyrolyzing and hydrogenating a carbonaceous material or resulting from pyrolyzing such a material and then hydrogenating the resulting oil, and mixtures of the aforementioned oils. Oils commonly referred to as synthetic crude oils, syncrudes, are preferred hydrogenated distillate feedstock oils for the present process.

In addition to the aforementioned nitrogenous component, the feedstocks herein may contain minor amounts of aromatic hydrocarbons, sulfur-containing (chemically bound sulfur) hydrocarbons, and polycyclic hydrocarbons. Usually, however, they have but minimal contents of aromatic hydrocarbons because of the hydrogenative treatment incidental to their origins.

Extracting Medium

Conventional extraction liquids have been found to be unsatisfactory for removing residual nitrogenous contents from a hydrogenated oil. For example, furfural was found to be ineffective in extracting a hydrogenated creosote oil containing about 70 ppmw of residual nitrogen compounds. Thus, after 3 extraction stages using furfural solvent and a 1-to-1 solvent-to-oil volumetric ratio, only about 56% of the nitrogenous component had been removed. This is surprising in view of prior art teaching, for example in British patent Specification No. 943,239 or in a paper in Chem. Age. Ind., Vol. 25, 103 (1974), by M. and A. Mukhopadhyay. On the other hand, in the present process when the extraction was carried out under the same conditions except that furfural containing about 5 weight percent of ferric chloride was used as the extracting phase, at least 99% of the residual nitrogenous components of the oil was removed. This is a surprising and useful result, especially in view of the fact that no precipitate was formed (see, for example, U.S. Pat. Nos. 2,780,582, 2,796,387 and 3,193,496) and little, if any, concurrent polymerization of the furfural solvent occurred. Ferric chloride promotes the extraction by furfural of the residual nitrogenous component of a hydrogenated distillate oil.

At least a major portion of the extracting liquid should be furfural. Thus, when the above-described extraction is carried out under the same conditions except that 50 volume percent of the furfural is replaced by methanol, only about 93% of the nitrogenous component had been removed. The comparative results were as follows:

| Solvent | N Content of Product (ppmw) | Denitrogenation, % |
|---|---|---|
| 5% $FeCl_3.6H_2O$ in Furfural | 0.9 | 99 |
| 5% $FeCl_3.6H_2O$ in 50/50 Furfural-MeOH | 4.8 | 93 |

Undiluted furfural is therefore superior as an extracting medium to diluted furfural. Preferably the organic solvent employed for the process herein contains at least about 80 volume percent of furfural, and most preferably consists essentially of furfural. Where a diluted solvent is to be used, the diluent is desirably a lower alkanol, for example methanol, ethanol, and the like relatively polar organic compounds.

The furfural solvent used in the process may be recovered by any suitable known method, for example using a distilling method as described in Ind. Eng. Chem., 40, 220 (1949), and Encyclopedia of Chemical Technollogy, Kirk-Othmer, 2nd Ed., Vol. 18, pp 549–564.

$FeCl_3$ Extraction Promoter

The amount of ferric chloride desirably present in the extracting medium varies, depending in the main upon the amount of nitrogenous component present in the hydrogenated oil feed. The concentration of ferric chloride in the furfural extracting solution should be, based upon solvent, in the range from about 0.001 to 10, preferably 0.01 to 5, and more preferably about 0.1 to 1 weight percent. Desirably, ferric chloride is the sole metal chloride extraction promoter.

Solvent-to-Oil Ratio

The solvent-to-oil volume ratio desirably used varies, depending in the main upon the extracting and the phase-separating temperatures employed. In either case, the temperature is desirably below about 50° C, and the solvent-to-oil ratio is desirably below about 5, although higher temperatures and solvent-to-oil ratios may be used and yet obtain a useful extraction and phase separation. As temperature is increased, the solubility of oil in the furfural extracting phase, and of furfural in the oil phase, increases. As a result, the efficiency of the process gets smaller with increasing temperatures. A solvent-to-oil ratio in the range of from about 5 to 0.1 is, in general, satisfactory. Preferably the operating conditions herein include an extracting temperature in the range from about 0° to 50° C, and a volumetric solvent-to-oil ratio in the range from about 0.1 to 3, more preferably 10° to 30° C and about 0.5 to 1.5, respectively. In a more particular preferred aspect of the invention, the phase separation is effected at a temperature which is in the range of about 5° to 25° C lower than the extracting temperature.

Upgraded Hydrogenated Oils

In general, the upgraded oils produced by the process herein exhibit reduced fouling rates relative to the rates for the corresponding unextracted hydrogenated oils when these oils are used as feedstocks under comparable conditions in a process stage requiring a catalyst whose desired activity is dependent, in the main, upon Broensted-type acid sites. These upgraded oils are, therefore, especially useful as improved feedstocks for catalytic cracking or catalytic hydroprocessing (isomerizing, hydrofining and hydrocracking) stages using (1) an amorphous and acidic silica-alumina cracking catalyst composite; (2) a composite as in (1) which contains a minor amount in the conventional manner of a crystalline aluminosilicate molecular sieve component, for example of X-, Y-, L-, faujasite-, erionite- and mordenite-type sieves in the H-form; or (3) a composite as in (1) or (2) which contains a Group VIII hydrogenation component, especially a platinum or palladium component. In addition, where a Group VIII hydrogenation component is present, the catalyst may also contain a Group VI-B component in the usual manner.

In the combination process of the present invention wherein at least a portion of the upgraded hydrogenated oil is catalytically cracked or hydroprocessed under catalytic cracking or hydroprocessing conditions using an acidic Broensted-type catalyst, these conditions include:

| Parameter | Hydro-processing | Cat. Cracking |
|---|---|---|
| | Suitable Range | |
| Temperature, ° C | 200–540 | 425–540 |
| Total pressure, atm. | 1–300 | 1–4 |
| Hydrogen partial pressure, atm. | 2–200 | — |
| Hydrogen rate, SCL/L | 100–9000 | — |
| Liquid hourly space velocity, V/V/Hr. | 0.1–25 | 5–20 |

What is claimed is:

1. A process for upgrading a hydrogenated distillate oil containing a residual nitrogenous component in an amount, calculated as nitrogen, in the range of from about 10 to 600 ppmw, comprising:

(1) extracting a major portion of said component from said oil using a solution of ferric chloride, said extracting being under conditions including (a) a temperature in the range of from about 0° to 50° C and (b) a solution-to-oil volume ratio in the range of from about 0.1 to 5, said solution containing at least a major portion of furfural as the solvent thereof and containing said ferric chloride therein in the range of from about 0.001 to 10 weight percent thereby forming a raffinate oil phase containing a minor portion of said nitrogenous component; and (2) withdrawing said raffinate oil phase from step (1).

2. A process as in claim 1 wherein at said withdrawing step (2) the temperature of said phases is below said contacting temperature by an amount in the range of from about 5° to 25° C.

3. A process as in claim 1 wherein said volume ratio is in the range of from about 0.1 to 3 and said amount of ferric chloride is in the range of from about 0.01 to 5 weight percent.

4. A process as in claim 1 wherein said temperature range is 10° to 30° C, said volume ratio range is 0.5 to 1.5 and said amount of ferric chloride is in the range of from about 0.1 to 1 weight percent.

5. A process as in claim 1 wherein said solution contains at least about 80 volume percent of furfural.

6. A process as in claim 1 wherein said solvent consists essentially of furfural.

7. A process as in claim 1 wherein said raffinate oil phase has a residual nitrogenous component content which is below about 10 ppmw.

8. A process as in claim 1 wherein said raffinate oil phase has a residual nitrogenous component content which is below about 2 ppmw.

9. A process for removing at least 50 percent of a residual nitrogen component from a hydrogenated hydrocarbon distillate feedstock comprising:

(1) extracting a first portion of said nitrogen component from said feedstock in a first counter-current extraction column using as the extracting liquid a first extract produced in a second counter-current extraction column, (2) as hereinafter deliniated recovering from said first column a first raffinate and a second extract;

(3) extracting a second portion of said nitrogen component from said first raffinate in said second column using as the extracting liquid a solution of ferric chloride, said solution containing (a) at least a major portion of furfural as the solvent thereof and (b) an amount of ferric chloride in the range of from about 0.001 to 10 weight percent; and (4) recovering from said second column a second raffinate and said first extract, said second raffinate containing not more than 50 percent of said nitrogen component.

* * * * *

UNITED STATES PATENT AND TRADEMARK OFFICE

CERTIFICATE OF CORRECTION

PATENT NO. : 4,113,607

DATED : September 12, 1978

INVENTOR(S) : Stephen J. Miller

It is certified that error appears in the above-identified patent and that said Letters Patent are hereby corrected as shown below:

Col. 3, line 19, "decives" should read --devices--.

Col. 5, line 13, "Technollogy" should read --Technology--.

Col. 6, line 68, "column, (2) as hereinafter deliniated" should read --column as hereinafter deliniated (2)--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*